US006923340B2

(12) United States Patent
Ambs

(10) Patent No.: US 6,923,340 B2
(45) Date of Patent: Aug. 2, 2005

(54) SYSTEM AND METHOD FOR STORING, TRANSPORTING AND DISPENSING BULK PARTICULATE MATERIALS AND DISPENSING APPARATUS THEREFOR

(75) Inventor: Richard W. Ambs, Williamsport, PA (US)

(73) Assignee: The Young Industries, Inc., Muncy, PA (US)

( * ) Notice: Subject to any disclaimer, the term of this patent is extended or adjusted under 35 U.S.C. 154(b) by 101 days.

(21) Appl. No.: 10/373,727

(22) Filed: Feb. 27, 2003

(65) Prior Publication Data

US 2004/0169050 A1 Sep. 2, 2004

(51) Int. Cl.[7] ..... B65D 35/56; B67D 5/06

(52) U.S. Cl. ..... 222/105; 222/630; 222/637; 222/195; 222/608; 222/181.2; 222/460; 222/537; 406/39; 414/415

(58) Field of Search ..... 222/105, 181.2, 222/630, 461, 637, 195, 460, 325, 527, 529, 537, 608–610; 406/39; 141/114; 414/403, 415, 787

(56) References Cited

U.S. PATENT DOCUMENTS 2,694,515 A * 11/1954 Green ..... 141/300
3,961,655 A * 6/1976 Nattrass et al. ..... 383/24
4,167,235 A * 9/1979 Green ..... 222/105
4,527,716 A * 7/1985 Haas et al. ..... 222/83.5
4,846,377 A * 7/1989 Fix et al. ..... 222/195
4,913,321 A * 4/1990 Abboud ..... 222/195
5,184,759 A * 2/1993 Gill et al. ..... 222/181.3
5,507,602 A * 4/1996 Walker ..... 406/122
5,944,070 A * 8/1999 Schmidt et al. ..... 141/114
5,947,333 A * 9/1999 Hoffmann et al. ..... 222/105

* cited by examiner

*Primary Examiner*—Michael Mar
*Assistant Examiner*—Patrick Buechner
(74) *Attorney, Agent, or Firm*—Stevens, Davis, Miller & Mosher, LLP

(57) ABSTRACT

An apparatus attachable to a bag containing a bulk particulate material and having a discharge spout for dispensing material from the bag generally consisting of first and second annular clamping members displaceable axially between a first, spaced apart condition permitting a portion of the spout to be drawn in position therebetween, and a second, adjacent condition clamping the spout portion position therebetween, and means for releasably retaining the members in the clamping condition.

13 Claims, 3 Drawing Sheets

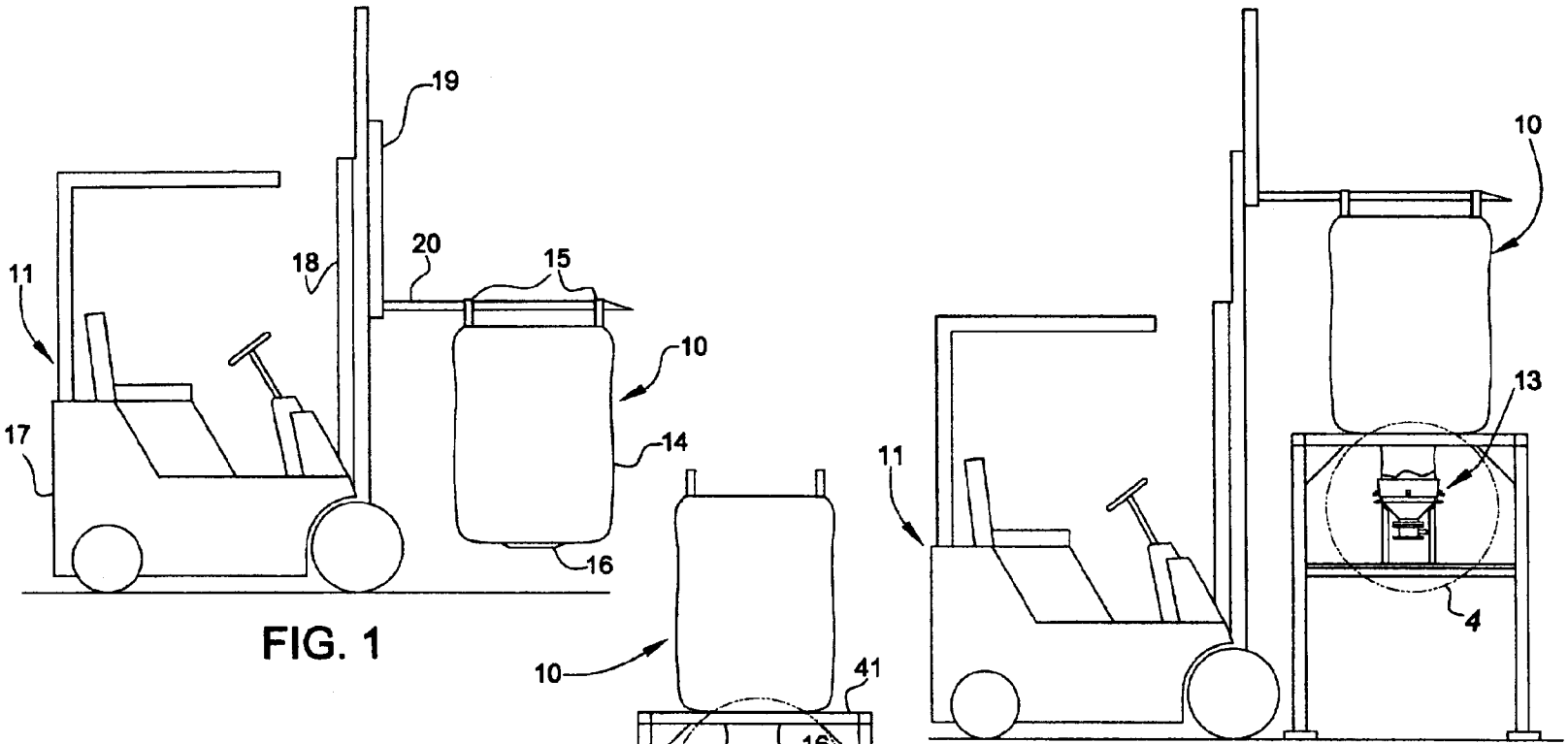
FIG. 2
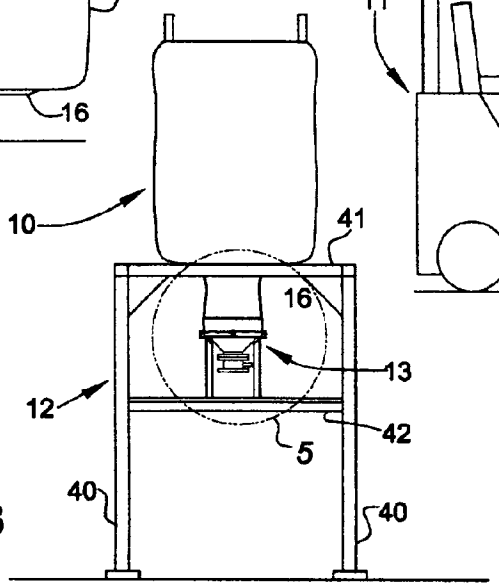
FIG. 3
FIG. 1

SYSTEM AND METHOD FOR STORING, TRANSPORTING AND DISPENSING BULK PARTICULATE MATERIALS AND DISPENSING APPARATUS THEREFOR

This invention relates to a system and method for storing, transporting and dispensing bulk particulate solids, and more particularly to such a system and method for dispensing controlled amounts of such material. The invention further contemplates a novel apparatus detachably mountable on a material container for metering controlled amounts of such material.

BACKGROUND OF THE INVENTION

In many industries utilizing bulk particulate materials, such materials often are stored and transported in large bags having a set of straps on the upper ends thereof for suspending them and elongated spouts on the lower ends thereof through which material may be discharged. Such spouts usually are closed by a rope or other suitable means adjacent the base ends thereof, and folded up against the bottom walls of the bags. Typically, such bags are stored on pallets in storage areas. When it is desirable to use such material, perhaps for a processing operation using a blender, reactor or other vessel, the bags are lifted, transported to the processing site and positioned above the vessel into which the material is to be dispensed, a handler reaches under the bag and unties the rope restricting the flow of material through the spout and the material is allowed to gravity flow through the spout into the vessel. Such practice, however, has not been found to be entirely satisfactory in several respects. Typically, there is very limited working space below a bag suspended over a vessel to permit the handler to easily maneuver and release the rope restraining the flow of material through the spout. Furthermore, the material often will not flow freely out of the bag or will flow uncontrollably, adversely affecting the process operation, particularly when seeking to blend the particulate material with a liquid. In addition, it often is hazardous for the handler to work below a suspended bag to either release the spout for discharging the material or induce flow of poorly flowing or clogged material.

Accordingly, it is the principal object of the present invention to provide an improved system and method of storing, transporting and discharging bulk particulate material in which the material may be easily transported to its dispensing site and readily discharged, and the material handler at the dispensing site will not be exposed to any hazardous conditions in freeing the spout or inducing the gravity flow of poorly flowing or clogged material.

SUMMARY OF THE INVENTION

The present invention consists of a system for transporting bulk particulate materials generally comprising a bag including a discharge spout for holding such material, means for transporting the bag from a first site to a second site, and means detachably mountable on the spout for metering the discharge of material from the bag. Preferably, the bag includes a set of straps provided on the upper end thereof for suspending the bag and an elongated spout at the lower end thereof which may be closed by means of a rope or other suitable means, the transporting means comprises a fork lift truck having a set of blades on which the straps of the bag may be connected to suspend the bag therefrom, the metering means comprises a dispensing apparatus including a hopper detachably mountable on the free end of the bag spout, a valve for metering the flow of material through the device and means for fluidizing the material in the hopper to enhance the flow therethrough, and a support structure is provided which functions to support the bag and dispensing apparatus thereon to facilitate the attachment of the dispensing apparatus onto the bag spout and the detachment of such apparatus therefrom.

BRIEF DESCRIPTION OF THE DRAWINGS

FIG. 1 is a side elevational view of a bulk material bag carried by a transporting vehicle, comprising components of a system embodying the present invention;

FIG. 2 is a view similar to the view shown in FIG. 3 including a support structure comprising another component of such system;

FIG. 3 is a view similar to the view shown in FIG. 2, illustrating the bag detached from the transport vehicle and resting on the support structure;

DETAILED DESCRIPTION OF AN EMBODIMENT OF THE INVENTION

Figure 4:
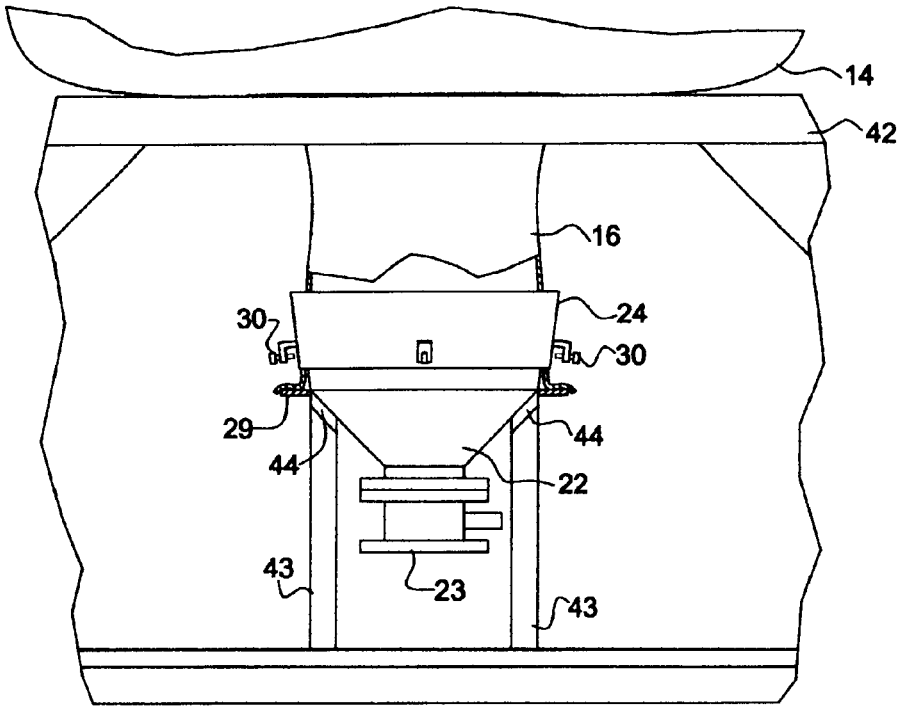
FIG. 4 is an enlarged view of the section shown in FIG. 2 designated by the numeral 4.

Referring to the drawings, there is illustrated a system for storing, transporting and dispensing a bulk particulate material embodying the present invention which generally consists of a bag 10 adapted to hold a bulk particulate material, a fork lift truck 11 on which such bag may be supported, transported and lifted and lowered, a support structure 12 on which such bag may be supported and a dispensing apparatus 13 which may be detachably mounted on such bag and also supported on such support structure to facilitate its attachment and detachment with respect to the bag. Bag 10 is of a conventional construction consisting of a main body portion 14, pairs of straps 15 provided on the upper end thereof and a spout 16 provided on the lower end thereof, formed of a flexible material capable of confining various bulk particulate materials being handled. Discharge spout 16 has a substantially tubular configuration when opened, including an inlet at the upper end thereof communicating with the interior of the main body portion and an outlet at the lower end thereof through which material may be discharged. Typically, when not in use, the spout is closed at the upper end thereof by means of a rope or other suitable device and the rest of the spout is folded against and detachably secured to the underside of the main body portion of the bag. The fork lift truck also is of a conventional construction including a chassis 17 mounted on a set of wheels and having suitable propulsion means, a mast 18 mounted on the front end of the chassis and a fork assembly 19 mounted on the front end of the mast and displaceable vertically thereon. The fork assembly is provided with a pair of transversely spaced blades 20 from which a bag 10 loaded with material may be suspended by means of straps 15. Normally, a bag 10 filled with material is stored in a suitable area on a pallet.

Whenever it is desired to transport such bag from a storage area to a processing or other site, such movement may be accomplished by adjusting the blades of the fork assembly at a suitable height, advancing the truck to insert the blades in straps 15, raising the fork assembly to lift the bag off of the supporting pallet and then driving the truck to the desired processing or other site.

Dispensing apparatus 13 is adapted to be detachably mounted on the free end of spout 16 in its unfolded, depending condition for controlling the gravity flow of material from the main body portion of the bag therethrough. As best seen in FIGS. 4 through 7, such apparatus includes an upper hopper section 21, a lower hopper section 22 depending from and formed integrally with upper hopper section 13, a valve 23 depending from and formed integrally with lower hopper section 22 and a clamping member 24. Upper hopper section 13 has a frusto-conical configuration including an outer frusto-conically configured surface 21*a*. Lower hopper section 22 has a frusto-conical configuration with an upper inlet communicating with the upper hopper section and a lower outlet. Spaced inwardly from hopper sections 21 and 22 is a permeable wall member 22*a* through which air or another gas including an inert gas supplied through a line 26 may be injected at a low pressure to fluidize material passing through lower hopper section 22 and thus enhance its flowability. Valve 23 preferably is a butterfly valve having a detachable operating handle 27 with an elongated stem 28 to permit an operator to open and close the valve from a distance clear of a bag when the dispensing apparatus is mounted on the spout of an overhead bag as shown in FIG. 7.

Figure 6:
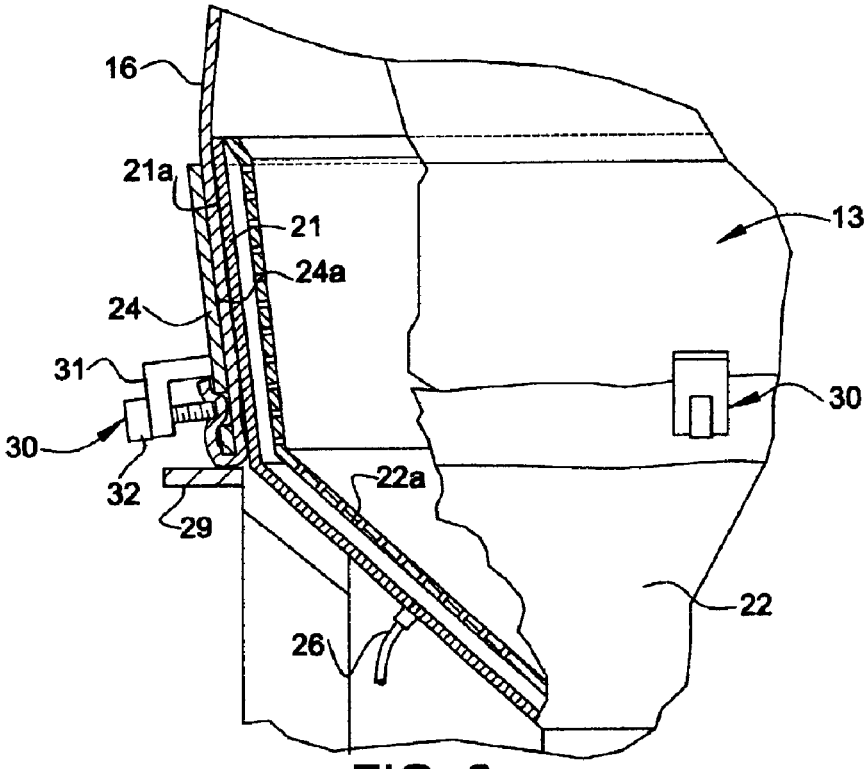
FIG. 6 is an enlarged view of the section designated by the numeral 6 in FIG. 5, having certain portions thereof shown in vertical cross section and other portions thereof broken away.
Figure 7:
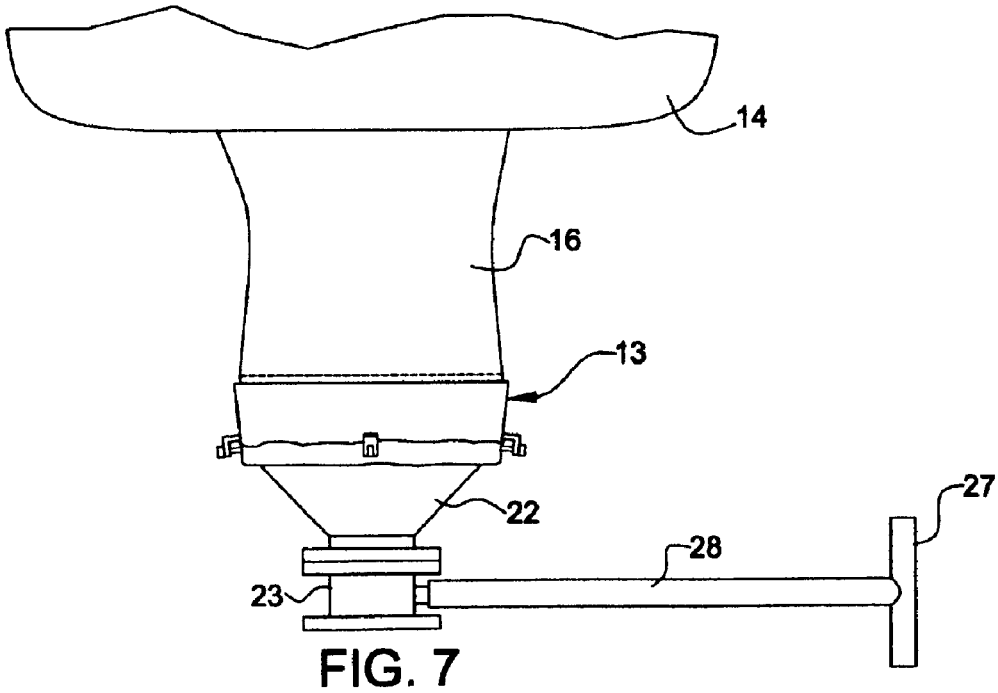
FIG. 7 is an enlarged elevational view of the bag shown in FIGS. 1 through 5, having a material dispensing device detachably mounted thereon, and having a portion thereof broken away.

The juncture of the upper and lower hopper sections is provided with an annular support ledge 29 on which the lower edge of clamping member 24 may be supported when not in a clamping position on the upper hopper section as shown in FIG. 6. Clamping member 24 is provided with a frusto-conically configured inner surface 24*a* which is adapted to cooperate with outer surface 21*a* of the upper hopper section to clamp a portion of spout 16 therebetween when such spout portion is inserted between upper hopper section 21 and clamping member 24, and clamping member 24 is displaced axially relative to the upper hopper section as shown in FIG. 6. The clamping member further is adapted to be retained in clamping relation with the upper hopper section with a portion of the spout disposed therebetween by means of a plurality of retainer assemblies 30 mounted on clamping member 24 and spaced circumferentially thereon. Each of such assemblies consists of a bracket 31 rigidly secured on the other side of the clamping member and a set screw 32 threaded in a threaded opening provided in the bracket thereof and having a head portion which may be gripped and turned by an operator and an inner end portion adapted to engage a portion of the spout clamped between the clamping member and the upper hopper section. As best shown in FIG. 6, the lower end of clamping member 24 is provided with a plurality of circumferentially spaced openings aligned with set screws 32 to permit the set screws to partially extend therethrough to engage an end portion of the spout and secure it against another portion of the spout positioned against the upper hopper section.

Figure 5:
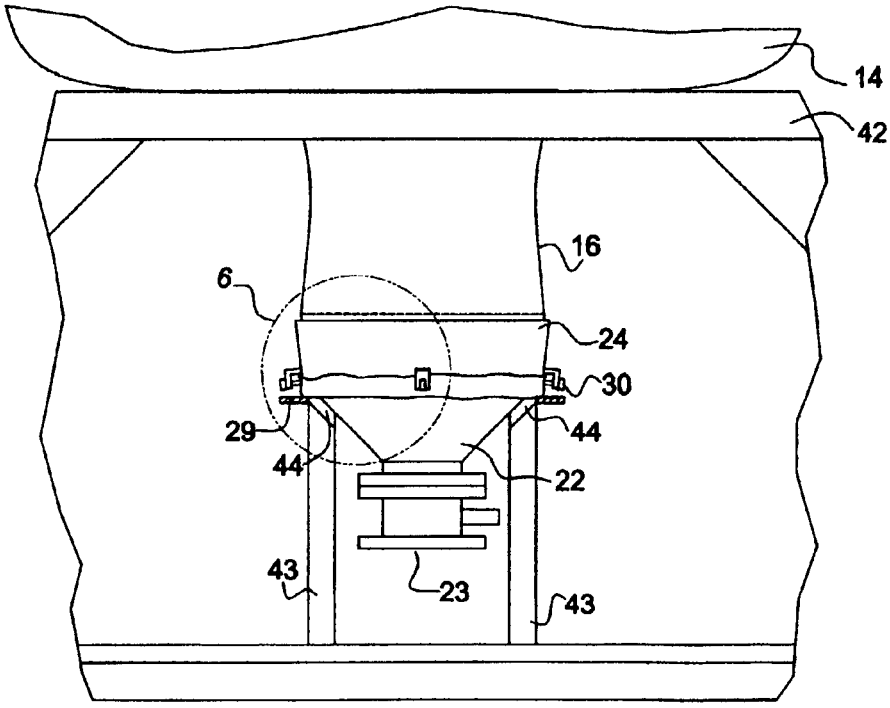
FIG. 5 is an enlarged view of the section shown in FIG. 3 designated by the reference numeral 5.

Support structure 12 consists generally of a stand upon which a bag 10 filled with a material and a dispensing apparatus 13 may be mounted to attach such dispensing apparatus to such bag. Generally, it includes a set of leg members 40 supporting an upper set of cross beam members 41 and a lower set of cross beam members 42. As best seen in FIGS. 4 and 5, a set of vertically disposed support members 43 having resting pads 44 on the upper ends thereof are provided below the upper end of the structure. The resting pads provide circumferentially spaced surfaces inclined at an angle and conforming to the outer surface of lower hopper section 22 so that the dispensing apparatus may be supported on such surfaces as shown in FIGS. 4 and 5. Alternatively, a flat annular member may be supported on the leg members upon which ledge 29 would be supported.

When not in use, dispensing apparatus 13 may be positioned on the resting pads of the support structure as shown in FIGS. 4 and 5. When it is desired to attach the apparatus to a bag filled with material to be dispensed, the fork lift truck is transported to the storage site of the bag usually resting on a pallet, the lift assembly of the truck is operated to engage the straps of the bag and lift it, the truck with the bag suspended therefrom is then transported to support structure 12 and positioned over it with the spout vertically aligned with the dispensing apparatus mounted on the support structure and then the fork lift assembly is operated to lower the bag and allow it to rest on the upper cross beams of the support structure as shown in FIG. 3.

With the bag filled with material to be dispensed and the dispensing apparatus both mounted on the support structure as shown in FIG. 3, the dispensing apparatus may be connected to the bag by first unfolding the spout from the lower end of the main body portion of the bag, allowing it to fall freely, and then guiding the lower end of the spout over the outer portion of the upper hopper section between the upper hopper section and the clamping member and then turning the end of the spout about the lower edge of the clamping member so that an intermediate portion of the spout is disposed between the clamping member and the upper hopper section and an end portion of the spout extends beyond the lower edge of the clamping member. The clamping member may then be moved upwardly or axially relative to the axis of the upper hopper section to engage the intermediate portion of the spout and clamp it against the outer surface of the upper hopper section. With the clamping number in such position, the end portion of the spout may be positioned against the outer surface of the clamping member and secured thereto by tightening set screws 32. As shown in FIG. 6, the end of each set screw will engage the upturned end portion of the spout and press it along with an intermediate portion of the spout against surface 21*a* of the upper hopper section. Under such conditions, the dispensing apparatus will be firmly, detachably connected to the unfolded, depending spout of the bag with the interior of the spout communicating with the upper hopper section, ready to be further opened at the neck portion thereof to permit material within the bag to gravity flow through the spout and into the dispensing apparatus. The rope restricting the upper end of the spout is then untied to allow material in the bag to gravity flow into the spout and the attached hopper.

With the bag still mounted on the support structure and the dispensing apparatus thus firmly, detachably secured to the spout thereof, the fork lift truck may be operated to lift the bag with the dispensing apparatus off of the support structure and transport it to the location where the material in the bag is to be dispensed. When the bag arrives at the dispensing site, the lift truck is operated to position the dispensing apparatus above and adjacent the receptacle in which the material is to be dispensed and an operator connects and manipulates the handle of valve 23 to allow material to flow through the dispensing apparatus into the receptacle. To enhance the flow of material through the dispensing apparatus, line 26 is connected to a source of air under pressure to supply air through permeable member 24 to fluidize material flowing through the lower hopper section. The material being dispensed may be accurately metered simply by turning handle 27 of the valve. The elongated stem portion of the handle permits the operator to stand clear of the elevated bag and thus avoid any injury in the event the lift mechanism of the fork lift truck falters or the bag may otherwise fall free from the fork lift assembly.

Once the material in the bag has been dispensed and it is desired to remove the dispensing apparatus, the bag with the dispensing apparatus attached thereto may be returned to the support stand and the dispensing apparatus may be positioned on support pads 44 with the bag supported on the upper set of cross beam members. The dispensing apparatus may then be detached simply by backing off set screws 32, lowering clamping member 24 to free the spout from between the clamping member and the upper hopper section and then lifting the lower end of the spout from between the clamping member and the upper hopper section. The dispensing apparatus may be left on the support structure for mounting on another bag and the fork lift truck may be operated to remove the empty bag and transport it to a desired location. In circumstances where the material in the bag may not be entirely dispensed, the bag with dispensing apparatus connected thereto may similarly be transported by the fork lift truck and positioned on the support structure for subsequent positioning and material dispensing.

It will be appreciated that by the use of the dispensing apparatus as described, bags filled with material may be readily dispensed in a controllable manner without risk of injury to the handlers of such bags.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. A system for transporting bulk particulate materials, comprising:

a bag including a discharge spout for holding such material;

means for transporting said bag from a first site to a second site; and means detachably mountable on said spout for metering the discharge of material from said bag, wherein said metering means includes an inner frusto-conically configured member and an outer frusto-conically configured member axially displaceable relative to said inner member for clamping a portion of said spout therebetween, said inner member having an outer surface against which a first portion of said spout may be drawn over and positioned, and said second outer member having an inner surface engageable with said first spout portion when drawn over and positioned on said outer surface of said inner member, for clamping said first spout portion between said inner and outer members, and at least one means for removably retaining said outer member in clamping relation with said inner member with said first spout portion disposed therebetween.

2. A system according to claim 1 wherein said outer member includes a lower annular edge around which a second portion of said spout may be turned and an outer surface against which a third portion of said spout may be drawn over and positioned, and wherein said retaining means is functional to removably retain said third spout portion positioned against said outer surface of said outer member.

3. A system according to claim 2 wherein said outer member includes an opening therethrough, a bracket disposed adjacent said opening and a threaded bolt threaded in said bracket and extendable in the direction of said opening and toward said inner member to urge a segment of said third and first spout portions against said inner member in retaining relation.

4. A system according to claim 1 wherein said metering means includes a valve.

5. A system according to claim 4 wherein said valve comprises a butterfly valve.

6. A system according to claim 1 wherein said metering means includes a hopper secured to and communicating with said inner member.

7. A system according to claim 6 wherein said hopper includes means for fluidizing material deposited therein for facilitating the flow of said material therethrough.

8. A system according to claim 7 wherein said hopper includes a frusto-conically configured impermeable wall and said fluidizing means include a permeable wall spaced inwardly relative to said impermeable wall to form a chamber therebetween and means for introducing air under pressure into said chamber.

9. A system according to claim 6 wherein said hopper is supported on said inner member.

10. A system according to claim 6 including a valve supported on said hopper communicating with a discharge outlet thereof.

11. A system according to claim 1 wherein said metering means includes an annular flange providing a support for said outer member when said outer member is not disposed in said clamping relation.

12. A system according to claim 1 wherein said metering means includes said inner and outer members, a hopper supported on said inner member and communicating with an outlet of said inner member and a valve supported on said hopper and communicating with a discharge outlet of said hopper.

13. A system according to claim 12 wherein said metering means includes an annular support flange supported on said inner member upon which said outer member may be rested.

* * * * *